US006517589B1

(12) United States Patent
Huang et al.

(10) Patent No.: US 6,517,589 B1
(45) Date of Patent: Feb. 11, 2003

(54) MANUFACTURING METHOD OF COLORING AND LUSTERING SUBSTANCE

(75) Inventors: Po-Hsiung Huang, ChihZhi (TW); Hung-En Chen, ChungHo (TW); Jung-Shen Lien, Taipei (TW)

(73) Assignee: China Textile Institute, Taipei (TW)

( * ) Notice: Subject to any disclaimer, the term of this patent is extended or adjusted under 35 U.S.C. 154(b) by 100 days.

(21) Appl. No.: 09/711,144

(22) Filed: Nov. 14, 2000

(51) Int. Cl.[7] ..... D06P 5/00

(52) U.S. Cl. ..... 8/474; 8/474; 8/475; 8/476; 8/114; 8/114.6

(58) Field of Search ..... 8/114, 114.6, 474, 8/475, 476

(56) References Cited

U.S. PATENT DOCUMENTS 3,918,901 A * 11/1975 Ida et al. ..... 8/172
4,339,477 A * 7/1982 Bahr et al. ..... 427/146
5,819,350 A * 10/1998 Wang ..... 8/149.3
5,953,780 A * 9/1999 Schollmeyer et al. ..... 8/158
6,010,542 A * 1/2000 DeYoung et al. ..... 8/474
6,048,369 A * 4/2000 Smith et al. ..... 8/475
6,120,558 A * 9/2000 Poddevin et al. ..... 8/137.5
6,183,521 B1 * 2/2001 Lin et al. ..... 8/139
6,187,383 B1 * 2/2001 McCain et al. ..... 427/388.1
6,200,637 B1 * 3/2001 McCain et al. ..... 427/336
6,261,326 B1 * 7/2001 Hendrix et al. ..... 8/475

* cited by examiner

*Primary Examiner*—Yogendra N. Gupta
*Assistant Examiner*—Eisa Elhilo
(74) *Attorney, Agent, or Firm*—Rosenberg, Klein & Lee

(57) ABSTRACT

The present invention provides a novel manufacturing method for coloring and lustering substance, especially suitable for coloring and lustering a carbonizable substance, without using pigments or dyes. The method utilizes the relationship between heat, gas and time to allow a substance to directly form and change color. The color-forming or color-changing phenomena is due to the natural quantity change effects caused by the heat, gas and time, which comprises at least one kind of color, color series or color and luster change.

5 Claims, No Drawings

MANUFACTURING METHOD OF COLORING AND LUSTERING SUBSTANCE

FIELD OF THE INVENTION

This present invention relates to a manufacturing method for coloring and lustering substance, especially relates to a method of directly color-forming and color-changing toward the substance by utilizing the relationship between the heat, aroma and time. It can also proceed the physical and chemical property change of the substance at the same time. The manufacturing method is especially suitable for the color and lustre processing or manufacture of the carbonizable substance, such as cellulose and thin film.

BACKGROUND OF THE INVENTION

Conventional methods of coloring the substance such as the direct coloring method of paints, dyeing, spraying . . . etc., or the indirect coloring method of pasting, copying, all require a coating of outer pigments, dyestuff or coloring material to make the color of the substance more conspicuous. This method has the advantage of fast and simple manufacturing and low cost. As the pigment technique, since the color of the substance depends completely on the coated material's color, luster and stability and the environmental or time factor changes, the color of the substance also changes. For example, this method has some drawbacks, such as chromatic aberration, coloring fixation, color deficiency, color loss, and so on. This is especially true when fabricating or processing certain kinds of color substances, which often cause many environmental problems, industrial safety problems or severe hindrance of industrial development.

Recently, due to the continuous innovation of academic research and scientific technique, a kind of color and lustre product by utilizing the optical reflective principle to produce polaroid color is gradually more and more popular. Polaroid color only depends on the reflection of light without utilizing any pigment, dyestuff or coloring material to produce magnificent color and luster. For this method, the environmental or industrial safety problem is avoided, and the other drawbacks will also not be produced. However, since the polaroid color product is not spontaneous color and luster, i.e., all the color depends on the reflection of light so that what kind of substance used neither has color selectivity nor have color stability. It is only suitable for zero diopter facet processed material and it loses the basic usage meaning of color and lustre toward purity, design characteristics as well as sense of universal. Further, this method uses cellulose products as an example, it is nearly impossible for modern optical polaroid techniques since the surface of the cellulose is cylinder typed or irregular typed, especially the cellulose products are all group set. There naturally appears the rough characteristic on the surface of group set, so it is hard to produce the polaroid color and luster.

The present invention provides a novel substance manufacturing method. The method utilizes the relationship between the heat, aroma and time to let the substance directly form and change color. Meanwhile the amelioration of physical and chemical properties can be searched for.

The method of this invention wherein the phenomena of color-forming or color-changing is due to the natural quantity-change effects caused by heat, aroma and time, which comprises at least one kind of color, color series or color and luster change. It could also take place as a result of interaction and mixing. Usually, the quantity-change property is the result of temperature wearing and chemical wearing.

For this method, the heat refers to the environmental temperature, the aroma refers to the change of the kind of gas in the environment, concentration or ratio, and aroma can be formed by the inert gas, active gas, or the mixing gas of both. The inert gases include the nitrogen gas, the helium gas . . . etc. Active gases comprise steam, oxygen gas, carbon dioxide . . . etc. Time refers to the effect of time, effect required by the bearing the temperature and aroma action of the processed material or the manufactured material.

The characteristic of this invention is that it could proceed color and lustre giving without through the processing of pigment and dyestuff. For example, this invention can perform permanent quality-change color on the surface of the material to have the characteristics of color stability, color and luster design as well as a less hazardous to the environment production process. This invention can broadly be suitable in the usage of the processing or manufacturing of the color and luster of the carbonized material. The carbonizable material especially includes thin film, cellulose, or the set body of which the thin film and cellulose are major components. Such materials are as follows: acrylamide series, cellulose series, phenol resin series, which property can be a kind of synthetic or semi-synthetic polymer material.

This invention not only can be used to produce the special product with stable color, and color and luster. It especially can avoid the environmental protection or industrial safety problem derived from the direct coloring method and indirect coloring method. It can suitably elevate the physical and chemical performance of the material, meanwhile this invention can be practiced immediately and can be used to effectively elevate the industrial efficiency and breakthrough many on industrial upgrade.

DETAILED DESCRIPTION OF THE PREFERRED EMBODIMENT

The preferred embodiment of this invention is further depicted as follows.

EXAMPLE 1

The Manufacture of Carbonizable Cellulose Material

The traditional carbonizable substance reacts by thermal cracking at the temperature between 200 to 1100° C., which comprises oxidation and carbonization. The oxidation or carbonization process can greatly improve the heat-wearing and chemical stability of the substance. It can even elevate the strength and stiffness of the certain type of substance. However, this kind of substance is black, which extremely lacks the visual beauty or color design much less as the degree of stiffness elevates, the degree of softness is relatively lowered. As a result, it is not ideal for the application performance of cellulose fiber-suitability and gauze woven-suitability.

The invention is practiced in reality in certain carbonizable substances. The procedure comprises setting up the three process blocks, which includes initial block, reactive block, and post-treatment block.

Initial block, which treats with relatively low temperature and aroma, and gives necessary pre-setting time, the preferred relatively low temperature is 80–220° C., the input aroma is formed mainly by the inert gas, active gas or the mixing gas of both.

During the reactive block, which treats with relatively high temperature and aroma, also gives necessary reactive time. The preferred relatively high temperature is 120–350° C., the input aroma is formed mainly by the inert gas, active gas or the mixing gas of both.

Post-treatment block treats with relatively low temperature and aroma, gives necessary time for stability. The preferred relatively low temperature is 80–220° C., the input aroma is also formed mainly by the inert gas, active gas or the mixing gas of both.

Besides, in order to further elevate the strength, degree of dispersion and quality of substance, it could apply the necessary manufacturing tension in process. Furthermore, in order to lower the energy consumption and to control variables of the process such as temperature and aroma, it could design the process system as near-close shaped except for the necessary input/output apparatus, and the temperature and aroma in each block could be supported, flowed through or recalled.

The process of this invention as mentioned above could determine the change of the product, said color and luster change is determined mainly by the quality of the giving heat energy, the aroma control and the action time.

EXAMPLE 2

The Manufacture of PAN Series Cellulose Bundle

The sample specification is: 5 dTex 66.6K PAN cellulose bundle, the characteristic of the color and lustre is a semi-glazed white, the embodiment according to this invention is practiced as follows:

1. Initial tension 3.5 Kg/bundle, initial temperature 110° C., temperature-enduring aroma treatment.
2. Reactive tension 4.0 Kg/bundle, reactive temperature 130° C. temperature-enduring aroma treatment.
3. Post-treatment tension 5.0 Kg/bundle, post-treatment temperature 110° C., temperature-enduring aroma treatment.
4. Aroma state N2:O2=1:2, pressure state 15 psia (normal pressure), output speed 500 mm/min.

The above practiced result produces: 4.8 dTex 66.6K PAN cellulose bundle, the characteristic of the color and lustre is a full-glaze yellow.

EXAMPLE 3

The Manufacture of Rayon Series Cellulose Bundle Color and Lustre

The sample specification is: 3 dTex 98K PAN cellulose bundle, the characteristic of the color and lustre is glazeless white, the embodiment of this invention is practiced as follows:

1. Initial tension 1.0 Kg/bundle, initial temperature 105° C., temperature-enduring aroma treatment
2. Reactive tension 1.0 Kg/bundle, reactive temperature 250° C. temperature-enduring aroma treatment
3. Post-treatment tension 1.0 Kg/bundle, post-treatment temperature 230° C., temperature-enduring aroma treatment
4. Aroma state steam:O2=2:1, pressure state 15 psia (normal pressure), output speed 160 mm/min.

The above practiced result produces: 3 dTex 98K Rayon cellulose bundle, the characteristic of the color and lustre is semi-glaze black.

As shown above, the unique and innovative quality of this invention in reality function has been explained. Although this invention has been disclosed with the preferred embodiment as above, it is not to be used to limit this invention. Anyone who is familiar with the technique could make some change and modification of this invention, so long as they do not depart from the main idea of this invention. So the protective scope of this invention views the definition of claim in appendix as standard.

What is claimed is:

1. A manufacturing method for coloring and lustering substance, comprising the steps of:

(a) placing a carbonizable agent selected from the group consisting of cellulose, cellulose derivative, thin film, acrylamide, acrylamide derivatives, phenol resin, phenol resin derivatives, asphalt, asphalt derivatives, synthetic polymers and semi-synthetic polymers into a vessel;

(b) heating said carbonizable agent under pressure throughout a series of processing stages;

(c) mixing said carbonizable agent under pressure within each of said processing stages with a composition selected from the group of an inert gas, an active gas and mixtures thereof.

2. The method for coloring and lustering substance as recited in claim 1, wherein said processing stages include an initial stage, a reactive stage and a post-treatment stage, said initial stage being maintained at a temperature between 80–220° C., said reactive stage being maintained at a temperature between 120–350° C., said post-treatment stage being maintained at a temperature between 80–220° C.

3. The method for coloring and lustering substance as recited in claim 1, including the step of applying a predetermined pressure to said carbonizable agent to increase the strength, degree of dispersion and quality of said carbonizable agent.

4. The method for coloring and lustering substance as recited in claim 1, wherein said inert gas is selected from the group consisting of nitrogen or helium.

5. The method for coloring and lustering substance as recited in claim 1, wherein said active gas is selected from the group consisting of steam, oxygen and carbon dioxide.

* * * * *